US009281090B2

(12) United States Patent
Leleu et al.

(10) Patent No.: US 9,281,090 B2
(45) Date of Patent: Mar. 8, 2016

(54) PACKAGING FOR TRANSPORTING AND/OR STORING RADIOACTIVE MATERIAL

(71) Applicant: TN International, Montigny le Bretonneux (FR)

(72) Inventors: Gilda Leleu, Paris (FR); Kévin Massif, Colomiers (FR)

(73) Assignee: TN INTERNATIONAL, Montigny le Bretonneux (FR)

( * ) Notice: Subject to any disclaimer, the term of this patent is extended or adjusted under 35 U.S.C. 154(b) by 0 days.

(21) Appl. No.: 14/409,183

(22) PCT Filed: Jun. 27, 2013

(86) PCT No.: PCT/EP2013/063492
§ 371 (c)(1),
(2) Date: Dec. 18, 2014

(87) PCT Pub. No.: WO2014/001443
PCT Pub. Date: Jan. 3, 2014

(65) Prior Publication Data

US 2015/0170774 A1 Jun. 18, 2015

(30) Foreign Application Priority Data

Jun. 28, 2012 (FR) ..... 12 56189

(51) Int. Cl.

| | |
|---|---|
| ***G21F 5/06*** | (2006.01) |
| ***G21F 7/015*** | (2006.01) |
| ***G21F 5/08*** | (2006.01) |
| *G21F 1/08* | (2006.01) |

(Continued)

(52) U.S. Cl.
CPC .. *G21F 5/06* (2013.01); *G21F 5/08* (2013.01); *G21F 7/015* (2013.01); *G21F 1/085* (2013.01)

(58) Field of Classification Search
CPC ..... G21F 5/015
See application file for complete search history.

(56) References Cited

U.S. PATENT DOCUMENTS 2,912,591 A 11/1959 Cervi
3,549,888 A * 12/1970 Conlon ..... G21F 5/015 220/315

(Continued)

FOREIGN PATENT DOCUMENTS

FR 508043 A * 9/1920 ..... G21F 5/015
FR 2 029 069 10/1970
GB 1 135 496 12/1968

OTHER PUBLICATIONS

French Search Report issued in Application No. FR 12 56189 dated Dec. 20, 2012.

(Continued)

*Primary Examiner* — Michael Logie
(74) *Attorney, Agent, or Firm* — Pearne & Gordon LLP

(57) ABSTRACT

Packaging for transporting radioactive material (1) comprising a radiation protection structure (4) comprising a shielding portion (5) defining a cavity (2) to house the radioactive material and a portion (7) having the effect of distancing the radioactive material from the outside of the packaging. The distancing-effect portion (7) directly encloses the shielding portion (5). The protection structure (4) has a thickness e associated with a segment (S) connecting a point (B) on the outer surface of the packaging to the center of gravity (G) of the cavity (2). It satisfies for any point (B): e=e1+e2 and 0.05<e1/e<0.25, where e1 is the thickness of the shielding portion (5), e2 is the thickness of the distancing-effect portion (7), with e1, e2 associated with the segment (S). The shielding portion (5) has a mean density of more than 8, the distancing-effect portion has a mean density of less than 0.5.

19 Claims, 7 Drawing Sheets

(56) References Cited

U.S. PATENT DOCUMENTS

| | | | | |
|---|---|---|---|---|
| 3,754,141 | A | 8/1973 | Leebl | |
| 4,935,943 | A | 6/1990 | Schweitzer | |
| 5,442,186 | A | 8/1995 | Walker | |
| 7,276,715 | B2 | 10/2007 | Climent | |
| 2008/0197302 | A1* | 8/2008 | Fago | G21F 5/015 250/506.1 |
| 2012/0037629 | A1* | 2/2012 | Morgan | G21F 5/12 220/260 |
| 2015/0170774 | A1* | 6/2015 | Leleu | G21F 7/015 250/506.1 |

OTHER PUBLICATIONS

International Search Report issued in Application No. PCT/EP2013/063492 dated Sep. 25, 2013.
Written Opinion issued in Application No. PCT/EP2013/063492 dated Sep. 25, 2013.
U.S. Appl. No. 14/405,966, filed Dec. 5, 2014.

* cited by examiner

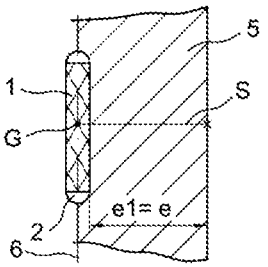
FIG. 2A1
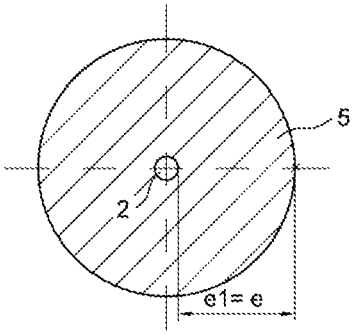
FIG. 2A2
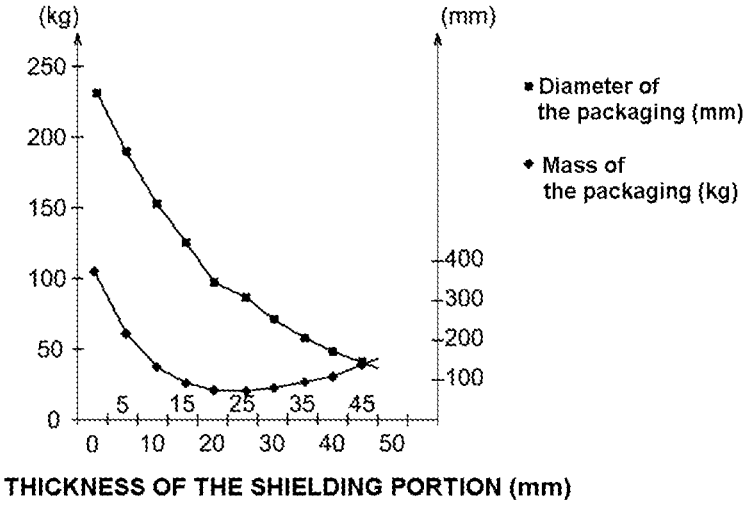
FIG. 3

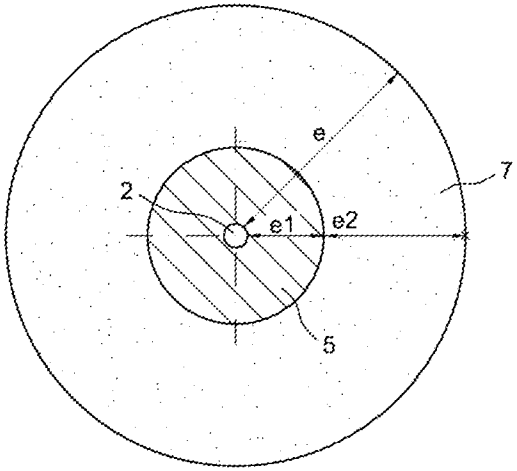
FIG. 2B2
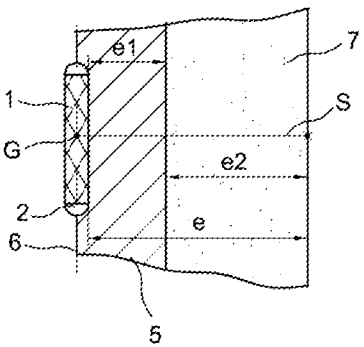
FIG. 2B1

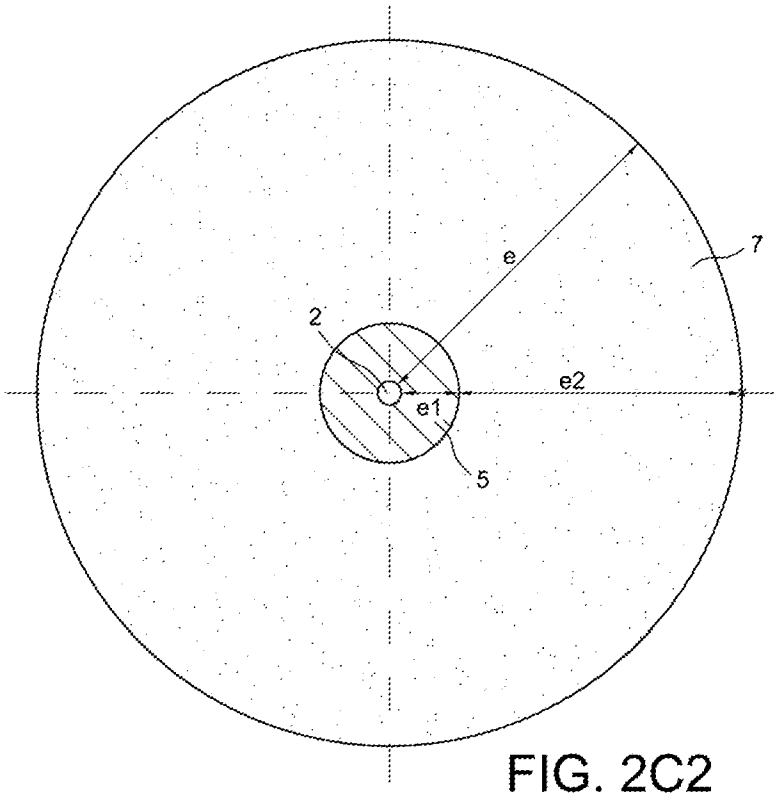
FIG. 2C2
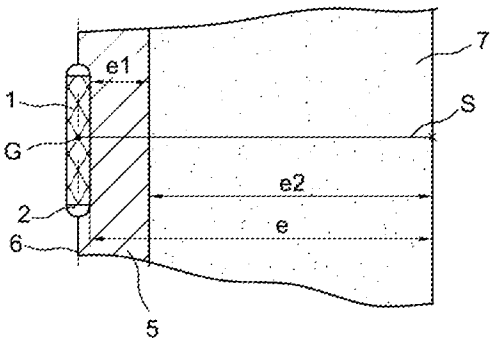
FIG. 2C1

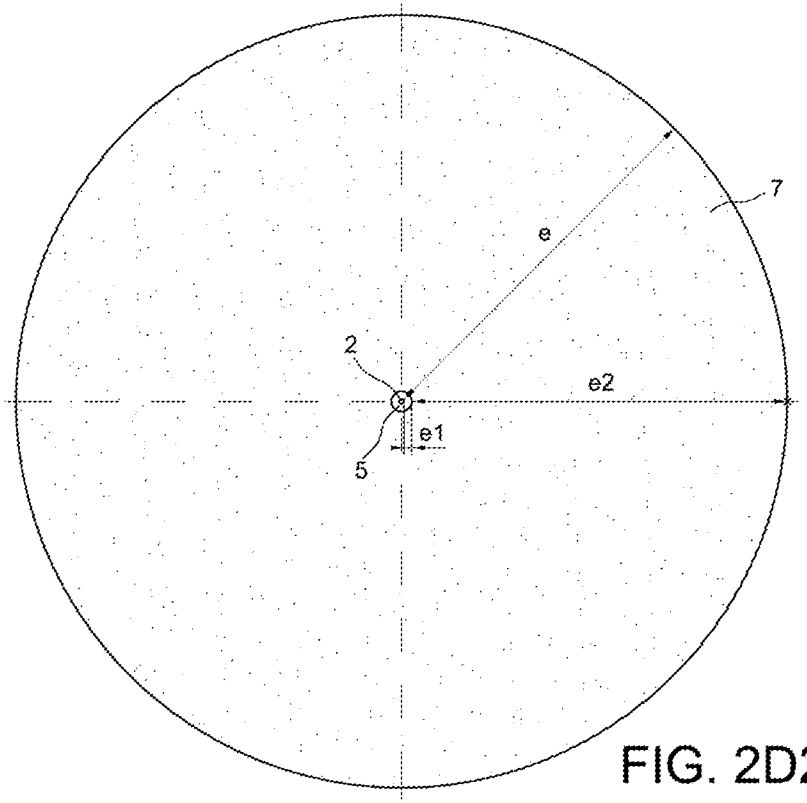
FIG. 2D2
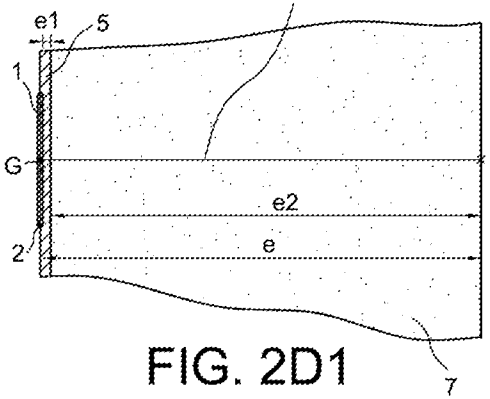
FIG. 2D1

PACKAGING FOR TRANSPORTING AND/OR STORING RADIOACTIVE MATERIAL

TECHNICAL FIELD

This invention relates to a packaging for transporting and/or storing radioactive material such as a radioactive source emitting highly energetic ionizing radiation. This ionizing radiation, such as gamma radiation, must be attenuated when the radioactive material is housed in the packaging for transporting and/or storing in such a way as to reduce the exposure of people to ionizing radiation.

More particularly but not exclusively, the invention relates to the transporting and/or storing of radioactive sources, such as radium, of which the application is preferentially an application in the medical field, for a therapeutic purpose.

PRIOR ART

In this type of packaging for radioactive source emitting highly energetic gamma radiation, it is sought to combine the criteria of mass and absorbed dose equivalent rate (DER) so that the packaging can be used sustainably by the same operator. The criterion of mass is that the packaging can be manipulated by an individual alone, with its mass having to be substantially less than or equal to 30 kg.

Recall that the regulatory limit in terms of transporting radioactive material for the dose equivalent rate at any point of the outer surface of the packaging is set to 2 mSv/h.

Another regulatory criterion that the packaging must satisfy is the dose equivalent rate at a distance of 1 meter from the outer surface of the packaging, this dose equivalent rate must be less than 0.1 mSv/h. However this latter criterion is substantially easier to satisfy for point or quasi-point radioactive sources. The criterion of maximum dose equivalent rate on the surface is as such preponderant.

In addition to the criteria of mass and of dose equivalent rate, the packaging loaded with the radioactive source must satisfy regulatory mechanical tests of which a drop test from a height of 1.2 meters. At the end of this test, the dose equivalent rate must not be subjected to an increase of more than 20%. The packaging must be sufficiently resistant to not be subjected to substantial deformation of its wall.

Currently, packagings for radioactive sources intended for medical applications, comprise substantially a radiation protection structure designed to attenuate the dose equivalent rate by exploiting the shielding effect of the ionizing radiation emitted by the radioactive source.

This shielding effect is the obtained by using high density materials such as lead, tungsten. This radiation protection structure defines a cavity intended to house the radioactive source.

In patent application FR 2 029 069, the packaging is a source-holder to be fastened in a teletherapy device. The radiation protection structure comprises a shielding portion made of a radiation protection material, with a density of more than 10, that contributes in defining the cavity and intended to house the radioactive source, closed in two concentric stainless steel cases that form a double-wall unit.

Other packagings for radioactive material are known for example the following documents: U.S. Pat. No. 7,276,715, U.S. Pat. No. 2,912,591, U.S. Pat. No. 5,442,186.

The disadvantage of these packagings is that, in order to respond to the criterion of the dose equivalent rate, they are two to three times heavier than what is recommended in order to be able to be manipulated and transported by a single person. The attenuation by the thickness x of the radiation protection material constituting the shielding portion follows the following relationship:

$D=D_0 \cdot e^{-\mu x}$ with $D_0$, the dose equivalent rate of one side of the radiation protection material, of the side where is housed the radioactive source, D, the dose equivalent rate of the other side of the radiation protection material, which corresponds to the outer surface of the packaging, μ, the attenuation coefficient of which the value depends on the nature of the radiation protection material and on the energy of the radiation of the radioactive source. It can be noted that when the radiation is of the gamma type, the attenuation coefficient of the radiation protection material is then higher the more substantial its density is.

Another disadvantage of the packagings described in the oldest documents is that they are no longer compliant with the recent operating requirements that aim to reduce as much as possible the dose equivalent rate at the outside of the packaging.

A transposition of their design in order to render them compliant with these operating constraints, more restrictive than the regulatory requirements, would generate a thickening of the radiation protection structure and therefore an inacceptable increase in the mass.

A third disadvantage of these packagings is linked to the hygiene constraints that are inherent in the medical sector.

The choice of certain surface materials is not possible due to their oxidation, by acids or other products used to carry out cleaning, decontamination or disinfection operations. This is for example stainless steel.

DESCRIPTION OF THE INVENTION

This invention indeed has for purpose to propose a packaging for transporting and/or storing radioactive material that does not have the aforementioned disadvantages.

More precisely, the packaging according to the invention meets the criteria of mass and of dose equivalent rate and the drop tests.

Another purpose of the invention is to provide a packaging for transporting and/or storing radioactive material that meets a criterion of dose equivalent rate measured in contact with the outer surface of the packaging, more ambitious that that imposed by the regulations.

Another purpose of the invention is to propose a packaging that can be cleaned and disinfected in order to meet the current hygiene constraints imposed in medicine.

In order to achieve these objectives, instead of increasing the thickness of the shielding portion in radiation protection material, which implies a substantial increase in the mass of the packaging, the idea is, in addition to the use of the shielding portion, to exploit the distancing effect or the remoteness effect with a portion of the packaging that has a mean density that is much lower than that of the radiation protection material. As such, contrary to prior art, it is sought to reduce the thickness of the shielding portion.

The attenuation of the dose equivalent rate by this distancing effect results for a point or quasi-point radioactive source in the following way: the dose rate at a point is inversely proportional to the square of the distance that separates this point from the point or quasi-point radioactive source.

More precisely, this invention relates to a packaging for transporting and/or storing radioactive material comprising a radiation protection structure that comprises a portion for shielding from an ionizing radiation emitted by the radioactive material, that has an inner surface that defines a cavity intended to house the radioactive material. According to the invention, the radiation protection structure comprises, furthermore, a portion that has an effect of distancing the radioactive material from the outside of the packaging, the distancing-effect portion directly encloses the shielding portion and having an outer surface which is the outer surface of the packaging, the radiation protection structure having a thickness e belonging to a straight line segment connecting a point (B) on the outer surface of the packaging to the center of gravity (G) of the cavity, with this thickness e satisfying for any point (B):

$$e=e1+e2$$

and $$0.05<e1/e<0.25$$

with e1 the thickness of the shielding portion, e2 the thickness of the distancing-effect portion, with the thicknesses e1 and e2 belonging to the straight line segment. The mean density of the shielding portion is more than 8 and the mean density of the distancing-effect portion is less than 0.5.

Furthermore, the cavity has, more preferably, a larger dimension that is less than the thickness e of the radiation protection structure.

Preferably, the mean density of the distancing-effect portion is less than 0.3. Note that the attenuation of the dose equivalent rate, obtained thanks to the shielding effect of the distancing-effect portion is then negligible.

The shielding portion is made, more preferably, from lead, tungsten, depleted uranium or of the alloys thereof and its mean density is more than 10.

The shielding portion comprises two half-shells intended to be placed side by side.

Preferably, the shielding portion comprises a central portion and two end portions on either side of the central portion, with the central portion being thickened with respect to the end portions.

In a first embodiment, the distancing-effect portion has a volume that is entirely filled by contiguous filling elements of which the density is less than 0.5. In this first embodiment, the distancing-effect portion therefore comprises no empty space between the contiguous filling elements.

In a first alternative, one or several of these filling elements are made from a material of which the density is less than 0.5 such as wood, polyurethane foam, phenolic foam.

In a second alternative, one or several of these filling elements have a cell structure of the honeycomb type, of the corrugated cardboard type. In this latter case, the filling elements always have a density less than 0.5, but the material from which they are made can have a density of more than 0.5, such as aluminum or cardboard.

The filling elements of the first alternative can also be qualified as more massive than those of the second alternative.

The filling elements of these two alternatives can take the form of a hollow element intended to house the shielding portion and of a bracing stopper intended to close off a portion of the hollow element.

The hollow element can be lined exteriorly by an outer cladding in the shape of a pot, and the bracing stopper can be lined with a cover that can be locked onto the outer cladding, with this outer cladding and this cover being part of the solid elements of the distancing-effect portion.

In another embodiment, the distancing-effect portion comprises structural elements and air. The latter has more than about 70% of the global volume of the distancing-effect portion. The structural elements can be made from polyethylene and more particularly from high density polyethylene. These materials have the advantage of being easily cleaned and disinfected in order to meet in particular the current hygiene constraints imposed in medicine.

The structural elements can comprise a pair of bracing elements of the shielding portion with an inner bracing element and an outer bracing element, mounted one inside the other and separated by air.

When the shielding portion comprises a thickened central portion, the outer bracing element can comprise a lateral wall and an abutment that protrudes interiorly from the lateral wall in order to brace the central portion of the shielding portion while arranging a thickness of air between the lateral wall of the outer bracing element and the shielding portion.

In this configuration, the inner bracing element comes to bear on the shielding portion when the latter abuts against the abutment of the outer bracing element.

Preferably, in order to improve the distancing effect without excessively increasing the mass of the packaging, the structural elements can include an additional bracing element mounted around the pair of bracing elements with a lateral wall and an abutment that protrudes interiorly from the lateral wall in order to brace the outer bracing element of the pair of bracing elements.

The additional bracing element can further comprise a guide ring that protrudes interiorly from its lateral wall in order to maintain the pair of bracing elements substantially centered in the additional bracing element.

It is provided in addition, that the structural elements further include a bracing stopper in order to brace the bracing elements of the pair one in relation to the other on one of their ends.

The bracing stopper can extend to the additional bracing element in order to brace it in relation to the pair of bracing elements.

It can be provided for the purpose for protection, for example, that the structural elements also comprise two additional elements materialized by an outer cladding in the shape of a pot and by a cover that can be locked onto the pot in order to house all of the other structural elements.

BRIEF DESCRIPTION OF THE DRAWINGS

This invention shall be better understood when reading the description of embodiments given, solely for the purposes of information and in no way restrictive, in reference to the annexed drawings wherein:

FIGS. 2A1, 2A2, 2B1, 2B2, 2C1, 2C2, 2D1, 2D2 show as a longitudinal cross-section and as a cross-sectional section a plurality of packagings of prior art and according to the invention;

FIG. 3 is a graph that makes it possible to choose the thickness of the shielding portion and of the packaging in order to meet the criteria of mass and of dose rate;

DETAILED DESCRIPTION OF PARTICULAR EMBODIMENTS

As has just been shown, the object of the invention is to optimize the mass of the packaging while meeting the criterion of dose rate at any point on its outer surface and the mechanical tests provided for by current regulations in terms of transporting radioactive material.

The underlying idea of the invention is to place the radioactive material into a cavity defined by a radiation protection structure that comprises a shielding portion, with this shielding portion directly enclosed by an outer portion designed to attenuate the ionizing radiation generated by the radioactive material thanks to a distancing effect of the radioactive material from the outer surface of the packaging. This outer portion must be as light as possible in order to not significantly increase the mass of the packaging, while being sufficiently resistant to not be subjected to substantial deformation at the end of the regulatory drop tests.

Figure 1A:
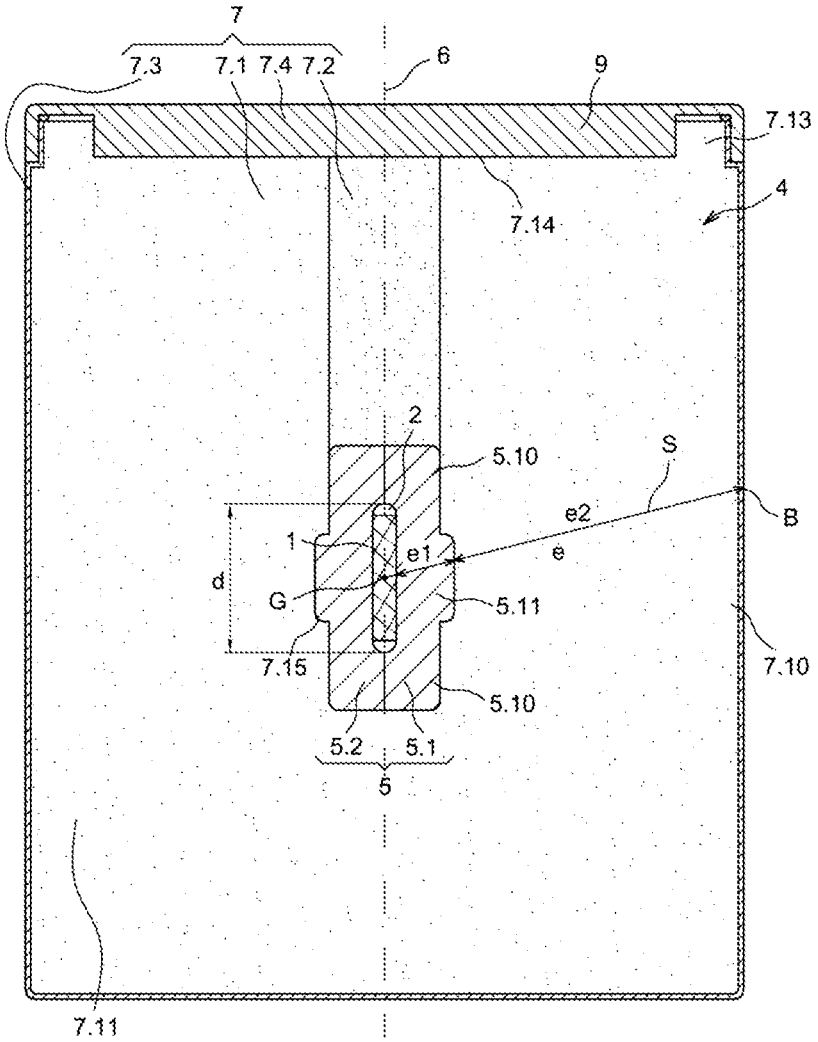
FIGS. 1A, 1B show respectively as a longitudinal cross-section and as a cut-away three-dimensional view a first embodiment of a packaging in accordance with the invention.
Figure 1B:
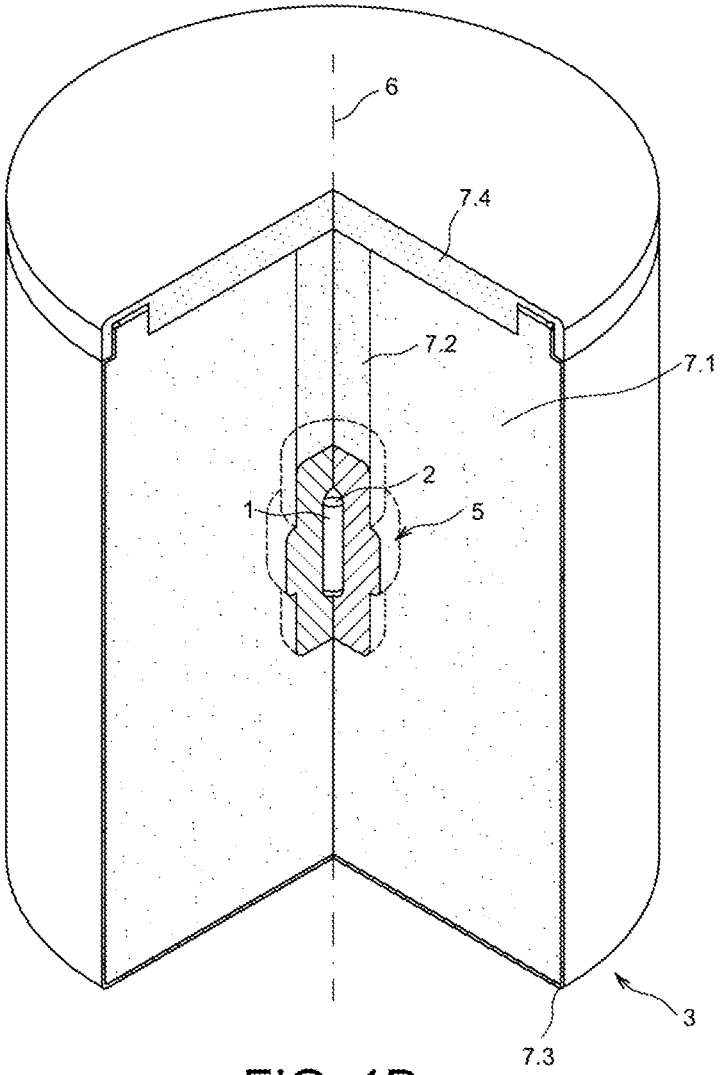

FIGS. 1A, 1B show a first embodiment of a packaging for transporting and/or storing radioactive material according to the invention.

In the central portion of these FIGS. 1A, 1B, a radioactive source 1 housed in a cavity 2 of the packaging 3 object of the invention can be seen. The radioactive source 1 has an extended shape and can be formed from a tube loaded with radioactive material such as radium 224. Other types of radioactive sources 1 could be used. It is considered that the radioactive source 1 is point or quasi-point and that the cavity 2 can house only one point or quasi-point radioactive source. Quasi-point source means the configuration for which the ratio between the largest dimension of the source and the thickness of the radiation protection structure is strictly less than 1.

The packaging 3, object of the invention, comprises a radiation protection structure 4 that contributes in defining the cavity 2 and which makes it possible to protect the external environment of the packaging 3 from the ionizing radiation produced by the radioactive source 1. In the example described with a radioactive source of radium, the ionizing radiation is gamma radiation.

Another function of the radiation protection structure is to provide a bracing and a mechanical protection for the radioactive source 1. Such a packaging 3 loaded with the radioactive source 1 must not be subjected to excessive mechanical deformation in case of a drop which could lead to an increase in the maximum dose equivalent rate of more than 20%.

The radiation protection structure 4 comprises a portion 5 for shielding from the ionizing radiation generated by the radioactive source 1. The shielding portion 5 has an inner surface that defines the cavity 2. The cavity 2 has a shape and dimensions that are slightly greater than those of the radioactive source 1 in such a way that the radioactive source 1 once installed in the cavity is immobilized. This cavity 2 can be similar to an imprint of the radioactive source 1.

The shielding portion 5 can be broken down into two substantially identical half-shells 5.1, 5.2, which when they are placed side by side as shown in FIGS. 1A, 1B, define the cavity 2 intended to house the radioactive source 1.

In the example described, the radioactive source 1 is shown as a globally revolution volume constructed about an axis 6, referred to as longitudinal axis. The shielding portion 5 also has a global revolution shape with a longitudinal axis 6 when the radioactive source 1 is housed in the cavity 2. The cavity 2 also has this global revolution shape with longitudinal axis 6. It is terminated by substantially half-spherical ends.

Its center of gravity is represented by the letter G. The position of the center of gravity G depends solely on the geometry of the cavity 2.

Other forms are of course possible, for example, prismatic for the radioactive source 1.

The shielding portion 5 is made from a material of which the density is more than 8.

This can be lead (density 11.3), tungsten (density 19.3), depleted uranium (density 19.05) or one of the alloys thereof. More preferably then, the mean density is more than 10. It can be considered that the shielding portion 5 be formed of several of these materials and be for example multilayer. The density spoken of here is a mean density. In this context, mean density of the shielding portion means the ratio of the mass of the shielding portion over its volume.

The shielding portion 5 comprises, preferably, longitudinally a succession of three portions, two end portions 5.10 surrounding a central portion 5.11. In this succession, the central portion 5.11 has a cross-sectional thickness greater than that of the end portions 5.10. In this context, the thickness is the difference that exists between the inner surface and the outer surface of each of the portions. These surfaces are substantially parallel at the level where the difference is measured.

The thickening of the central portion 5.11 has several advantages, it reinforces the attenuation of the ionizing radiation produced by the radioactive material with respect to the radioactive source 1, it facilitates the manipulation of the shielding portion 5 and it facilitates the bracing thereof.

The radiation protection structure 4 further comprises a portion 7 designed for an effect of distancing the radioactive source 1 from the outside of the packaging 3. This portion is called, in what follows, distancing-effect portion 7. It directly encloses the shielding portion 5. This means that it is directly adjacent to the shielding portion 5. This distancing-effect portion 7, contrary to the shielding portion 5, is made using elements of which the mean density is less than 0.5.

This distancing-effect portion 7 can be formed, in a first embodiment, only from contiguous filling elements as in the FIGS. 1A, 1B.

Figure 4:
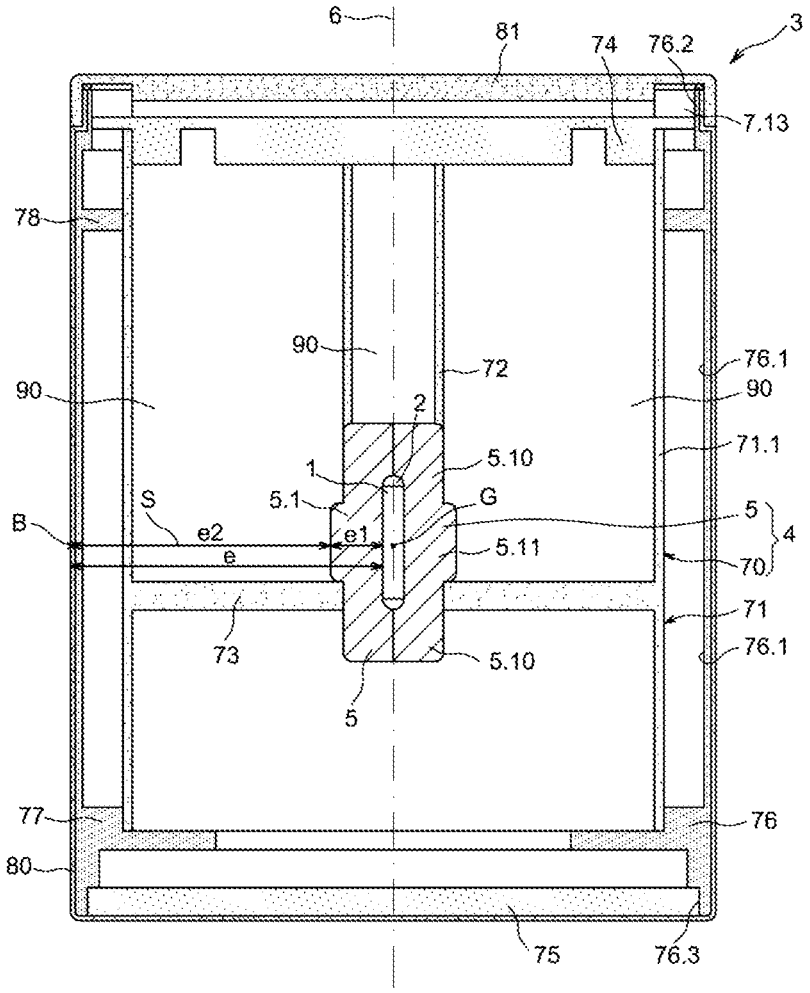
FIG. 4 shows as a longitudinal cross-section another embodiment of the packaging according to the invention.

In a second embodiment, it can be formed from structural elements that alternate with air in such a way as to reduce the global mass without weakening the mechanical resistance of the packaging 3, as shown in FIG. 4.

In a first alternative of the first embodiment, on or several of these filling elements are made from a material of which the density is less than 0.5 such as wood, polyurethane foam, phenolic foam. Balsa has a density of a magnitude of 0.1.

In a second alternative of the first embodiment, one or several of these filling elements have a cell structure of the honeycomb type, of the corrugated cardboard type. In this latter case, the elements always have a density of less than 0.5, but the material from which they are made can have a density of more than 0.5, such as aluminum or cardboard.

In the example of FIGS. 1A, 1B, first filling elements of the distancing-effect portion 7 take the form of a hollow element 7.1 intended to house the shielding portion 5 and of a bracing stopper 7.2 intended to close off a portion of the hollow element 7.1. It could be considered that the hollow element instead of being monolithic, be subdivided into several sub-elements stacked one on the other for example.

In the example described, the hollow element 7.1 has a lateral wall 7.10 substantially in the shape of a cylinder of revolution associated with a bottom 7.11. The lateral wall 7.10 and the bottom 7.11 define a housing 7.12 for the shielding portion 5. The housing 7.12 has a shape and dimensions chosen in order to laterally brace the shielding portion 5 when it rests on the bottom 7.11. The thickened central portion 5.11 of the shielding portion 5 contributes to this bracing, as it rests as such on a step 7.15 made in the lateral wall 7.10. Opposite the bottom 7.11, the lateral wall 7.10 is terminated by an end 7.13 that defines an opening 7.14 making it possible to insert the shielding portion 5 into the hollow element 7.1.

The bracing stopper 7.2 comes to close off the housing 7.12 on the opening 7.14. It has an end intended to bear against the shielding portion 5 and of which the geometry is conjugated with that of the shielding portion in such a way as to brace in translation the shielding portion 5 in the housing 7.12.

It is preferable in order to confine the first filling elements 7.1, 7.2 described hereinabove in the distancing-effect portion 7, that the latter comprise second filling elements 7.3, 7.4 that take the form of an outer cladding 7.3 configured as a pot and a cover 7.4 that can be locked onto the outer cladding 7.3. The first filling elements 7.1, 7.2 are housed in the outer cladding 7.3 before locking the cover 7.4. This outer cladding 7.3 and its cover 7.4 can have a role of protecting the first filling elements 7.1, 7.2 with regards to the external environment in particular from humidity, friction, etc.

The outer cladding 7.3 and the cover 7.4 assembled to one another have an outer surface that defines the outer surface of the distancing-effect portion. This outer surface also constitutes the outer surface of the packaging on which the dose equivalent rate measurement is taken.

The outer cladding 7.3 and the cover 7.4 will preferably be made from one of the plastic materials mentioned hereinabove, rather than from cardboard or from aluminum.

Of course, this outer cladding 7.3 and its cover 7.4 are taken into account in the calculation of the mean density of the distancing-effect portion 7.

Here also, the mean density is the ratio of the total mass of the distancing-effect portion over its total volume. The total mass is the mass of all of its filling elements and the total volume is defined by the space between the inner and outer surfaces of the distancing-effect portion, such as defined hereinabove.

It is considered that the cavity 2 of the packaging according to the invention can accommodate only one point or quasi-point radioactive source 1. For this, the cavity 2 has a large dimension d that is less than the thickness e of the radiation protection structure 4.

In the context of this invention, the thickness e of the radiation protection structure 4 belongs to a straight line segment S connecting a point B on the outer surface of the packaging to the center of gravity G of the cavity 2. This thickness e satisfies the relationship (1):

e=e1+e2 with e1 the thickness of the shielding portion 5 and e2 the thickness of the distancing-effect portion 7. These thicknesses e1 and e2 belong to the straight line segment S. In fact e1 corresponds to the portion of the straight line segment S that extends into the shielding portion 5 and e2 corresponds to the portion of the straight line segment S that extends into the distancing-effect portion 7.

According to the invention, the condition on the thickness e of the radiation protection structure 4 and on the thicknesses e1, e2 of the two portions 5, 7 of the radiation protection structure 4 shall now be defined. The geometrical dimensions of the two portions 5, 7 of the radiation protection structure 4 are adjusted so that on the one hand the criterion of dose equivalent rate in contact with the packaging is respected and so that the mass is reduced with respect to prior art.

This adjustment leads to the relationship (2):

$0.05<e1/e<0.25$ in addition to the relationship (1).

FIGS. 2A1, 2A2, 2B1, 2B2, 2C1, 2C2, 2D1, 2D2 show partial longitudinal and cross sections of packagings of prior art or in accordance with the invention. In these examples, the thicknesses e1 and e2 were determined in such a way that the dose equivalent rate in contact with the packaging is identical and four times less than that which is regulatory. Its value must therefore be less than or equal to 0.5 mSv/h. The proportions between the various elements are respected. In FIGS. 2A2, 2B2, 2C2, 2D2 the radioactive source is not present in the cavity.

In the examples of FIG. 2, the estimation of the dose equivalent rate was carried out by neglecting the attenuation by the shielding effect of the distancing-effect portion. The mean density of the distancing-effect portion is considered solely for the calculation of the mass of the packaging which is carried out by considering that the packaging takes a general shape that is similar to that of FIG. 1B.

It is supposed that during the calculations, the distancing-effect portion, when it exists, is homogenized, it is for this that the first filling elements cannot be distinguished from the second filling elements.

A cross has been used to represent any point on the outer surface of the packaging that bounds the straight line segment that makes it possible to determine the thickness e of the radiation protection structure.

In FIGS. 2A1, 2A2, this is a packaging of prior art, the radiation protection structure 4 is limited solely to the shielding portion 5. The cavity 2 for the radioactive source 1 defined by the shielding portion 5 is shown in the center, extending around the longitudinal axis 6. The shielding portion is made of tungsten (density 19.3). Its thickness e1 with respect to the radioactive source 1 and therefore the cavity 2 is 50 mm. The cavity 2 has a diameter of 10 mm.

The mass of the packaging is 45 kg, which does not meet the mass criterion that the packaging of the invention has to meet. The thickness e1 is measured on the straight line segment S that goes from the cross to the center of gravity G of the cavity. In this example, the thickness e1 of the shielding portion 5 corresponds to the difference between the inner surface and the outer surface of the shielding portion as the straight line segment S is substantially perpendicular to the longitudinal axis 6. The inner and outer surfaces of the shielding portion are substantially parallel.

In FIGS. 2B1, 2B2, the radiation protection structure further comprises a distancing-effect portion 7 that directly encloses the shielding portion 5. The two portions are directly adjacent, they are in contact with one another. The distancing-effect portion 7 has a mean density of 0.2. This mean density is used only for calculating the mass of the packaging. This could be the distancing-effect portion of the first embodiment or of the second embodiment which shall be described later in relation with FIG. 4.

In this second example, the shielding portion has a thickness e1 of 35 mm and the distancing-effect portion a thickness e2 of 60 mm.

The two portions do not satisfy the relationship (2):

$$e=e1+e2=95 \text{ mm}$$

and $$0.05<e1/e<0.25$$

because $e1/e=0.37$

The mass of the packaging is 32 kg and is still excessive so that the packaging can be manipulated by a single operator. This again is a packaging that does not belong to the invention.

In FIGS. 2C1, 2C2, the radiation protection structure also comprises the distancing-effect portion 7 directly contiguous with the shielding portion 5. The distancing-effect portion 7 has a mean density of 0.2. In this third example, the shielding portion 5 has a thickness e1 of 25 mm and the distancing-effect portion has a thickness e2 of 125 mm.

The two portions satisfy the relationships (1) and (2):

$$e=e1+e2=150 \text{ mm}$$

and $$0.05<e1/e<0.25$$

because $e1/e=0.17$

The mass of the packaging is 21 kg and is compliant with the mass criterion that was fixed. In addition, the largest dimension d of the cavity 2 is equal to 100 mm and is therefore less than the thickness e of the radiation protection structure.

In FIGS. 2D1, 2D2, the radiation protection structure also comprises the distancing-effect portion 7. As hereinabove, it has a mean density equal to 0.2. In this fourth example, the shielding portion 5 has a thickness e1 of 15 mm and the distancing-effect portion 7 has a thickness e2 of 200 mm.

The two portions 5, 7 satisfy the relationship (2):

$$e=e1+e2=215 \text{ mm}$$

and $$0.05<e1/e<0.25$$

because $e1/e=0.07$

However, note that the mass of the packaging again increases to reach 29 kg, it however remains acceptable so that the packaging can be manipulated by a single operator. The mass of the distancing-effect portion substantially increased with the increase in its thickness e2, making the packaging heavier.

It can be deduced from these examples that there are optimum values to be combined for the thickness of the shielding portion and the distancing-effect portion. It is not sufficient to reduce the thickness of the shielding portion and to substantially increase the thickness of the distancing-effect portion in order to obtain a packaging according to the invention.

FIG. 3 shows on the one hand the variation in the mass of the empty packaging according to the thickness of the shielding portion and on the other hand of the outer diameter of the packaging according to the thickness of the shielding portion. The diameter of the packaging is equal to the sum of the diameter of the cavity and twice the thickness of the radiation protection structure e of FIGS. 2A to 2D. The graphs are obtained for a dose equivalent rate in contact with the packaging constant. These graphs make it possible to easily choose the thickness of the shielding portion (between 15 and 25 mm) so that the mass of the packaging is less than 30 kg. It is supposed here that the diameter of the cavity is 10 mm.

Interest shall now be given to the second embodiment of the packaging according to the invention by referring to FIG. 4. In this FIG. 4, the shielding portion 5 is similar to that described in FIGS. 1A, 1B. It will not be described again. The distancing-effect portion is now referenced as 70. It comprises structural elements and air. The air represents more preferably at least 70% of the global volume of the distancing-effect portion 70. The global volume of the distancing-effect portion shall be understood as the total volume of the distancing-effect portion, as defined hereinabove.

The structural elements are made, for example, from polyethylene and more particularly from high density polyethylene HDPE (density 0.94).

Among the structural elements, a pair of bracing elements 71, 72 mounted one inside the other and separated by air 90 can be provided.

These two bracing elements 71, 72 of the pair are constructed about a longitudinal axis 6 and are mounted coaxially. At least the outer bracing element 71 is of tubular shape, the other referenced as 72 and qualified as inner can also be of tubular shape or be solid. In FIG. 4, it is shown as tubular shape and is filled with air 90.

The outer bracing element 71 is open at one of its ends at least. It comprises a lateral wall 71.1 and an abutment 73 that protrudes interiorly from the lateral wall 71.1. In this embodiment, the abutment 73 takes the form of a recessed plateau. The abutment 73 is used to brace in translation the central portion 5.11 of the shielding portion 5. One of the end portions 5.10 of the shielding portion 5 passes through the recess of the plateau 73 when the shielding portion 5 is mounted in the outer bracing element 71. A thickness of air 90 is present between the lateral wall 71.1 of the outer bracing element 71 and the shielding portion 5 except on the abutment 73.

The two ends of the outer bracing element 71 can be open. The inner bracing element 72 comes to bear against the shielding portion 5 on its other end portion 5.10. It is without contact with the outer bracing element 71 of the pair. It contributes in maintaining the shielding portion 5 blocked in translation abutting against the recessed plateau 73 when the various portions of the radiation protection structure are assembled.

Also provided among the structural elements is a first bracing stopper 74 for maintaining in position the two bracing elements 71, 12 of the pair, with this first bracing stopper 74 being placed opposite the shielding portion 5 with regards to the inner bracing element 72.

In order to improve the distancing effect and the mechanical resistance of the packaging object of the invention, the structural elements can also include an additional structural element which is an additional bracing element 76 of tubular shape, mounted coaxially around the pair of bracing elements 71, 72 but at a distance, in such a way that the air 90 separates then laterally at least locally. This additional bracing element 76 comprises a lateral wall 76.1 which is terminated by at least one open end 76.2, with the latter located on the side of an open end of the outer bracing element 71 of the pair. This additional bracing element comprises an abutment 77 that protrudes interiorly from the lateral wall 76.1 in order to brace the outer bracing element 71 of the pair of bracing elements. It is also provided to provide the additional bracing element 76 with a guide ring 78 that protrudes interiorly from its lateral wall 76.1 in order to maintain the pair of bracing elements 71, 72 substantially centered in the additional bracing element 76.

In this example, the first bracing stopper 74 extends laterally to the open end 76.2 of the additional bracing element 76. It comes to close it off.

In the example described, the additional bracing element 76 comprises a second open end 76.3. Furthermore, among the structural elements, a second bracing stopper 75 is provided that comes to close the second open end 76.2.

These bracing elements 71, 72, 76 can exteriorly be cylinders of revolution or prisms, but other shapes are possible. In the example of FIG. 4, the bracing elements are increasingly long when moving from the inside of the packaging outwards, which makes it possible for the radioactive source to be sufficiently separated from any point on the outer surface of the packaging.

Furthermore, in order to confine the structural elements 71, 72, 74, 75, 76 described hereinabove, other additional structural elements can be provided such as an outer cladding 80 configured as a pot and a cover 81 that can be locked onto the outer cladding 80. The structural elements 71, 72, 74, 75, 76 are housed in the outer cladding 80 before locking the cover 81. This outer cladding 81 and its cover 82 can have the role of protecting the structural elements that it houses with respect to the external environment in particular the humidity, friction, etc.

Between two consecutive bracing elements, there is a thickness of air 90 which contributes to the distancing effect and of which the density is taken into account, during the determination of the value of the mean density of the distancing-effect portion. As such in FIG. 4, a cross is used to represent on the outer surface of the radiation protection structure, any point B of the measurement of the dose equivalent rate. This cross is opposite the cavity 2, on the central portion 5.2 of the shielding portion 5. The thicknesses e, e1, e2, defined hereinabove, are materialized on the straight line segment S that connects the cross to the center of gravity G of the cavity 2.

Although several embodiments of this invention have been shown and described in a detailed manner, it will be understood that various changes and modifications can be made in particular to the contiguous filling elements and to the structural elements without leaving the scope of the invention.

What is claimed is:

1. Packaging for transporting and/or storing radioactive material (1) comprising a radiation protection structure (4) that comprises a portion (5) for shielding from radiation emitted by the radioactive material, having an inner surface that defines a cavity (2) intended to house the radioactive material, characterized in that the radiation protection structure (4) comprises, furthermore, a portion (7, 70) that has an effect of distancing the radioactive material from the outside of the packaging, with the distancing-effect portion (7, 70) directly enclosing the shielding portion (5), and having an outer surface which is the outer surface of the packaging, the radiation protection structure (4) having a thickness e belonging to a straight line segment (S) connecting a point (B) on the outer surface of the packaging to the center of gravity (G) of the cavity (2), with this thickness e satisfying, for any point (B):

$$e=e1+e2 \text{ and } 0.05<e1/e<0.25$$

with e1 the thickness of the shielding portion (5), e2 the thickness of the distancing-effect portion (7), with the thicknesses e1, e2 belonging to the straight line segment (S), the shielding portion (5) having a mean density of more than 8 and the distancing-effect portion having a mean density of less than 0.5.

2. Packaging according to claim 1, wherein the cavity (4) has a larger dimension (d) that is less than the thickness e of the radiation protection structure (4).

3. Packaging according to claim 1, wherein the shielding portion (5) is made from lead, tungsten or depleted uranium or of the alloys thereof, with its mean density being greater than 10.

4. Packaging according to claim 1, wherein the mean density of the distancing-effect portion is less than 0.3.

5. Packaging according to claim 1, wherein the shielding portion (5) comprises two half-shells (5.1, 5.2) intended to be placed side by side.

6. Packaging according to claim 1, wherein the distancing-effect portion (7) is carried out using contiguous filling elements of which the density is less than 0.5.

7. Packaging according to claim 6, wherein one or several of these filling elements are made from a material of which the density is less than 0.5 such as wood, polyurethane foam, phenolic foam or one or several of these filling elements are made from a material of which the density is able to be greater than 0.5, such as aluminum or cardboard, with these filling elements having a cell structure of the honeycomb or of the corrugated cardboard type.

8. Packaging according to claim 6, wherein the filling elements comprise a hollow element (7.1) intended to house the shielding portion (5) and a bracing stopper (7.2) intended to close off a portion of the hollow element (7.1).

9. Packaging according to claim 8, wherein the hollow element (7.1) is lined exteriorly with an outer cladding (7.3) and the bracing stopper (7.2) is lined exteriorly with a cover (7.4) which can be locked onto the outer cladding, with this outer cladding and this cover being part of the elements of the distancing-effect portion.

10. Packaging according to claim 1, wherein the distancing-effect portion comprises structural elements (71, 72, 74, 75) and air (90).

11. Packaging according to claim 10, wherein the air (90) represents at least 70% of the global volume of the distancing-effect portion.

12. Packaging according to claim 10, wherein the structural elements are made from polyethylene, in particular high density polyethylene.

13. Packaging according to claim 10, wherein the structural elements comprise a pair of bracing elements (71, 72) of the shielding portion (5) with an inner bracing element (72) and an outer bracing element (71) mounted one inside the other and separated by air (90).

14. Packaging according to claim 13, wherein the outer bracing element (71) comprises a lateral wall (71.1) and an abutment (73) that protrudes interiorly from the lateral wall (71.1) in order to brace the central portion (5.11) of the shielding portion (5) while still arranging a thickness of air (90) between the lateral wall (71.1) of the outer bracing element (71) and the shielding portion (5).

15. Packaging according to claim 14, wherein the inner bracing element (72) comes to bear on the shielding portion (5) when the latter is abutting against the abutment (73) of the outer bracing element (71).

16. Packaging according to claim 10, wherein the structural elements further include an additional bracing element (76) mounted around the pair of bracing elements (71, 72) with a lateral wall (76.1) and an abutment (77) that protrudes interiorly from the lateral wall (76.1) in order to brace the outer bracing element (71) of the pair of bracing elements (71, 72).

17. Packaging according to claim 16, wherein the additional bracing element (76) further comprises a guide ring (78) that protrudes interiorly from its lateral wall (76.1) in order to maintain the pair of bracing elements (71, 72) substantially centered in the additional bracing element (76).

18. Packaging according to claim 10, wherein the structural elements further comprise a bracing stopper (74) in order to brace the bracing elements (71, 72) of the pair one in relation to the other on one of their ends.

19. Packaging according to claim 18, wherein the bracing stopper (74) extends to the additional bracing element (76) in order to brace it in relation to the pair of bracing elements (71, 72).

* * * * *